US005618186A

United States Patent [19]

Saka et al.

[11] Patent Number: 5,618,186

[45] Date of Patent: Apr. 8, 1997

[54] ELECTRICAL CONNECTION BOX

[75] Inventors: Yuuji Saka; Takahiro Onizuka; Yoshito Oka; Makoto Kobayashi; Nori Inoue, all of Yokkaichi, Japan

[73] Assignee: Sumitomo Wiring Systems, Ltd., Japan

[21] Appl. No.: 521,353

[22] Filed: Aug. 30, 1995

[30] Foreign Application Priority Data

Aug. 31, 1994 [JP] Japan ..... 6-207061
Sep. 8, 1994 [JP] Japan ..... 6-215014

[51] Int. Cl.[6] ..... H01R 9/09

[52] U.S. Cl. ..... 439/76.2; 439/948; 439/949

[58] Field of Search ..... 439/76.2, 404, 439/405, 723, 724, 948, 949, 954

[56] References Cited

U.S. PATENT DOCUMENTS 5,207,587 5/1993 Hamill et al. ..... 439/76
5,207,591 5/1993 Ozaki et al. ..... 439/949

*Primary Examiner*—Neil Abrams
*Assistant Examiner*—Barry Matthew L. Standig
*Attorney, Agent, or Firm*—Anthony J. Casella; Gerald E. Hespos

[57] ABSTRACT

An electrical connection box comprises a casing (10,11;111, 112) having a receiving portions (17–20;30;18';116,177) for making a mechanical connection with connecting portions (22–25;31;3';23) of external circuits, wherein an engaging surface (S;116*a*–118*a*) is formed in association with each of the receiving portions for the connecting portion of the respective external circuit, and internal circuits (W1,W2, 15A–15;D;W1, W2, 15E; W1,W2,120). The internal circuits comprise wires (W1,W2) arranged in at least one stage, and connection terminals (15A–15D;15E;120) which are connected with any of the wires (W1,W2) and which extend to respective receiving portions (17–20;30;18'; 116,117) of the casing (10,11; 111,112) so as to form input/output terminal portions (15*c*) for the electrical connection with the external circuits. The electrical connection box is formed such that, using one type of connection terminal (15A–15D;15E;120), the distance between the connection point of a connection terminal with a wire (W1,W2) and the corresponding engaging surface (S;116*a*–118*a*) is adjusted in accordance with the type of connecting portion (22–25;31;3';23) of the external circuit.

12 Claims, 5 Drawing Sheets

ELECTRICAL CONNECTION BOX

BACKGROUND OF THE INVENTION

1. Field of the Invention

The present invention relates to an electrical connection box for automotive vehicles and particularly to those electrical connection boxes which are designed to form internal circuits by wires and cramping terminals for connecting a multitude of external electrical circuits including e.g. fuses and relays in such a compact manner as to rationally realize joint connections of a wiring harness. Especially, the present invention is designed to reduce the number of kinds of parts of those electrical connection boxes.

2. Description of the Prior Art

Prior art electrical connection boxes for easily responding to a design change of the internal circuits, have used wires (instead of a busbar that is formed by punching a conductive metal plate) so that connections between the wires and external circuits are established by the use of cramping terminals.

In the above electrical connection box, the terminals cramped with the wires are connected with external circuits such as connectors, relays, fuses, etc. to be fitted in their receptacles formed projectingly on the outer wall of an upper casing and/or a lower casing as follows. The cramping terminals are mounted so that their input/output terminal portions formed at one end project into the receptacles for the external circuits from terminal holes formed in the outer wall of the casing. Upon fitting the external circuits in their receptacles, they are connected with the cramping terminals.

In the case where the above electrical connection box is made smaller by arranging the internal circuits in a highly compact manner, the wires need to be arranged at multiple stages.

More specifically, insulating plates are disposed in the space defined by upper and lower casings, thereby forming multiple vertical stages, and the wires are arranged at these stages.

The upper and the lower casings are generally formed to have flat walls on the outer surfaces of which the receptacles for the external circuits are formed, establishing engaging surfaces for the external circuits on the same horizontal plane and formed with the terminal holes for the cramping terminals.

Therefore, if the wires are arranged at multiple stages as described above, the wire at one stage is not as distant from the respective receptacle as the wire at another stage.

For example, as shown in FIG. 7, cramping terminals 3 are cramped with an upper wire W1 arranged in the interior of a casing consisting of an upper casing 1 and a lower casing 2. Input/output terminal portions 3*a* of cramping terminals 3 project into a connector receptacle 4, so that the cramping terminals 3 are directly fitted and connected with mating terminals (not shown) mounted in a connector 5 to be accommodated in the connector receptacle 4. On the other hand, shorter cramping terminals 6 cramped with the same wire W1 are mounted so that their input/output terminal portions 6*a* project less into a connector receptacle 7 which is longer than the receptacle 4, thereby allowing the cramping terminals 6 to be fitted and connected with mating terminals mounted in a connector (not shown) to be accommodated in the connector receptacle 7.

In other words, the cramping terminals 3 connected with the connector 5 to be accommodated with the connector receptacle 4 need to project from an engaging surface 4*a* of the connector receptacle 4 by a distance A. On the other hand, the cramping terminals 6 connected with the connector to be accommodated in the connector receptacle 7 need to project from an engaging surface 7*a* by a distance B. The relationship of the distances A and B is B<A.

In the example shown in FIG. 7, the cramping terminals 3 project from the engaging surface 4*a* by the distance A. If the cramping terminals having the same shape as the cramping terminals 3 are used in place of the cramping terminals 6, these cramping terminals also would project from the engaging surface 7*a* by the distance A, which is longer than the predetermined projecting distance B for the cramping terminals in connector receptacle 7.

Thus, it is necessary to use cramping terminals 6 having a shape different from that of the cramping terminals 3 so as to change the projecting distance of the input/output terminal portions from the position cramped with the wire W and, accordingly from the engaging surface.

In other words, cramping terminals of different shapes need to be prepared in conformity with the types of the external circuits to be connected, thereby causing an increase in the number of the types of the necessary cramping terminals. This leads to an increased production cost and a tedious parts management.

As also shown in FIG. 7, a distance L1 between the first wire W1 arranged on the upper surface of an insulating plate P and an engaging surface 4*a* of the connector receptacle 4 formed on the upper casing 1 is different from a distance L2 between a second wire W2 arranged on the lower surface of the insulating plate P and an engaging surface 4*a'* of a connector receptacle 4'. Specifically, L2>L1.

As a result, cramping terminals 3' to be cramped with the second wire W2 need to be longer than the cramping terminals 3 to be cramped with the first wire W1. More specifically, a portion (or length) of the cramping terminal 3' between a wire cramping portion 3*b'* and an input/output terminal portion 3*a'* thereof is longer than the corresponding portion (length) of the cramping terminal 3.

As is clear from the above, an attempt to make the internal circuits more compact by arranging the wires at multiple stages results in an increase in the number of types of cramping terminals. This disadvantageously leads to increased production costs and a more tedious parts management.

In view of the above problem, it is an object of the invention to reduce the number of types of parts of such connection boxes, and particularly to enable the use of cramping terminals of the same shape even in the case where wires are arranged at multiple stages and regardless of the types of external circuits to be connected with the cramping terminals.

SUMMARY OF THE INVENTION

By changing the distance of the engaging surfaces to the connection point, the input/output terminal portions of the connection terminals project from the engaging surface by the predetermined distances required for the mating connecting portions of the external circuits even if the connection terminals are of the same shape. Thus, connection terminals of the same shape can be used.

Particularly, the distance from the connection point to the engaging surface (height of the engaging surface) is preferably changed by changing the height of the bottom wall of the corresponding receptacle with which the leading end surface of the corresponding connection portion of the external circuit is brought into contact.

Alternatively, the height of the engaging surface may be changed by forming a rib projecting from the bottom wall or a side wall of the corresponding receptacle.

Further, the height of the engaging surface may be changed by forming a projection or rib projecting from an insulating plate mounted in the electrical connection box through an opening formed at the bottom of the corresponding receptacle.

If the height of the bottom wall of the receptacle is changed or the rib is formed, preferably when the upper casing and/or the lower casing are formed of resin, the engaging surface for the mating external circuit to be fitted in the receptacle can easily be changed.

Similarly, if the insulating plate which is preferably made of resin is formed with the rib, the height of the engaging surface can easily be changed.

According to the invention, since the casing is equidistant from the corresponding wires, cramping terminals of the same shape can be used. In other words, the terminals (preferably cramping terminals) which extend in a direction which is usually normal to the wiring planes of the multiple stages can connect any wire at any stage with any part of the casing (usually either a part of the casing above the multiple stages or a part below). Accordingly, the same type of cramping terminals can be used for all connections of wires and external circuits of this connection box.

Preferably, the stage distance between the stages of arrangement of wires (wire arrangement stages) is equal to the distance of the steps formed in the casing. Accordingly, the electrical connection box can be made as compact as possible.

It is further preferred that the wires are arranged along grooves formed in or along projections formed on a plate, particularly an insulating plate, and that wire cramping portions at one end of the cramping terminals are connected with the wires arranged on the insulating plate. Accordingly, the connection between the wires and the cramping terminals can be detected before they are installed in the casing.

Preferably, a specified number of wire arrangement stages are found only in one location along one direction so that the outer surface of the casing is formed in a stair-like manner Accordingly, the casing will not have a complicated outer configuration.

BRIEF DESCRIPTION OF THE DRAWINGS

These and other objects, features and advantages of the present invention will become more apparent upon a reading of the following detailed description and accompanying drawings in which.

DETAILED DESCRIPTION OF THE PREFERRED EMBODIMENT

Figure 1:
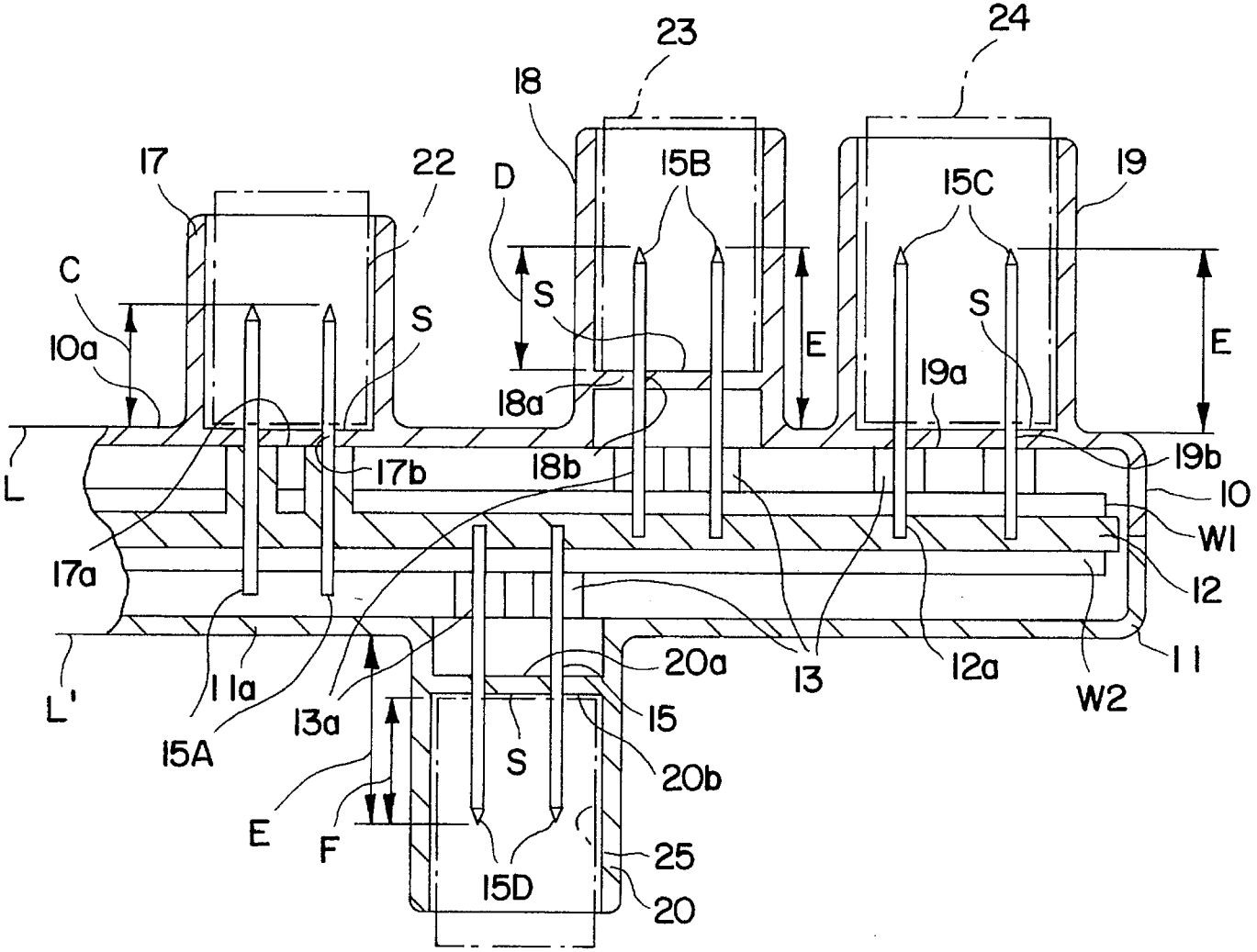
FIG. 1 is a longitudinal section of a first embodiment according to the invention.

FIG. 1 shows a first embodiment of an electrical connection box in which wires are arranged at two stages. Specifically, first and second wires W1 and W2 are arranged on the upper and the lower surfaces of an insulating plate 12 mounted in a casing consisting of upper and lower casings 10 and 11, respectively.

The insulating plate 10 is formed with projections 13, in conformity with a wiring pattern, at positions where cramping terminals are to be mounted. The projections 13 also act to guide the wires. Namely, each of the projections 13 consists of a pair of projections at opposite sides of the corresponding wire (see FIG. 2). Each pair of projections are spaced apart by a distance substantially equal to the diameter of the wire W1, W2. The wires are arranged and guided while being inserted between the pairs of the projections 13.

On the opposing inner surfaces of the respective projections 13, there are formed guide grooves 13*a*. The insulating plate 12 is formed with a groove 12*a* which is in communication with the grooves 13*a*.

First, second and third connector receptacles (receiving portions) 17, 18 and 19 are projectingly formed on an outer surface 10*a* of the upper casing 10 in positions corresponding to the projections 13. Further, a fourth connector receptacle (receiving portion) 20 is projectingly formed on an outer surface 11*a* of the lower casing 11 in a position corresponding to the projections 13.

Cramping terminals (connection terminals) 15 which are to be cramped with the first and the second wires W1 and W2 and whose input/output terminal portions project into the respective receptacles 17 to 20 are of the same shape.

Figure 2:
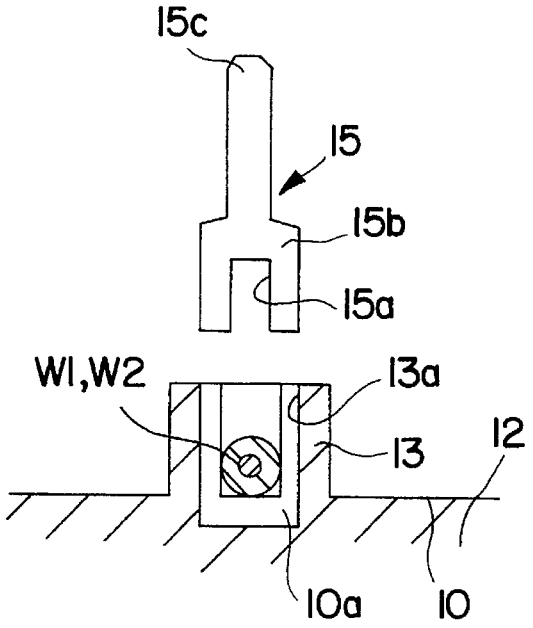
FIG. 2 is a lateral section showing a portion to be connected with a cramping terminal.

As shown in FIG. 2, each of the cramping terminals 15 has a known shape and includes a wire cramping portion 15*b* having a slot 15*a* at one end and a tab-shaped input/output terminal portion 15*c* at the other end. A blade formed at the periphery of the slot 15*a* cuts an insulation of the wire to establish an electrical connection between the cramping terminal and the wire.

Since the cramping terminals are of the same shape, the leading ends of the input/output terminal portions 15*c* of the cramping terminals 15B and 15C cramped with the first wire W1 are at the same height, while the leading ends of the input/output terminal portions 15*c* of the cramping terminals 15A cramped with the second wire W2 are located lower by a distance equal to a spacing between the first and the second wires W1 and W2.

Male terminals (tabs) to be connected with female terminals (not shown) mounted in a first connector (connecting portion) 22 to be fitted in the first Connector receptacle 17 need to have a length C. Accordingly, the cramping terminals 15A project into the first connector receptacle 17 from the outer surface 10*a* of the upper casing 10 as a reference line L by the distance C. A bottom wall 17*a* (flushing with the outer surface 10*a*) of the first connector receptacle 17 serves as an engaging surface S with which the leading end surface of the first connector 22 comes into contact while being located on the reference line L of the upper casing 10.

Male terminals (tabs) to be connected with female terminals (not shown) mounted in a second connector (connecting portion) 23 to be fitted in the second connector receptacle 18 need to have a length D. The cramping terminals 15B project into the second connector receptacle 18 from the reference line L of the upper casing 10 by a distance E. Since the distance E is longer than the distance D, the cramping terminals 15B would project too much if the reference line L of the upper casing 10 were used as an engaging surface for a second connector 23. Thus, a bottom wall 18*a* of the connector receptacle 18 is elevated above the reference position L by a distance equal to a difference (E–D) so that the bottom wall 18*a* serves as an engaging surface S with which the leading end surface of the second connector 23 comes into contact.

Male terminals (tabs) to be connected with female terminals (not shown) mounted in a third connector 24 fitted in the third connector receptacle 19 need to have a length E. The cramping terminals 15C project into the! third connector receptacle 19 from the reference line L by the distance E. Thus, a bottom wall 19*a* (flushing with the outer surface 10*a*) of the third connector receptacle 19 serves as an engaging surface S with which the leading end surface of the third connector 24 comes into contact while being located on the reference line L of the upper casing 10.

Male terminals (tabs) to be connected with female terminals (not shown) mounted in a fourth connector 25 fitted in the fourth connector receptacle 20 formed on the lower casing 11 need to have a length F. The cramping terminals 15D project into the fourth connector receptacle 20 from the outer surface 11*a* of the lower casing 11 as a reference line L' by the distance E. Since the distance E is longer than the distance F, the cramping terminals 15D would project too much if the reference line L' of the lower casing 11 were used as an engaging surface with which the leading end surface of the fourth connector 25 comes into contact. Thus, a bottom wall 20*a* of the connector receptacle 20 is lowered (as seen in FIG. 1) below the reference position L' by a distance equal to a difference (E–F) so that the bottom wall 20*a* serves as an engaging surface S with which the leading end surface of the fourth connector 25 comes into contact.

Terminal holes 7*b* to 20*b* are formed in the bottom walls 17*a* to 20*a* of the respective receptacles 17 to 20. The input/output terminal portions 5*c* of the cramping terminals 15 (15A to 15D) project into the respective receptacles 17 to 20 through the terminal holes 7*b* to 20*b*.

In the thus constructed electrical connection box, when the first to fourth connectors 22, 23, 24 and 25 are inserted into the corresponding receptacles 17 to 20 which are formed on the upper and lower casings 10 and 11, the leading end surfaces thereof come into contact with the bottom walls 7*a* to 20*a* and stay thereat.

The cramping terminals 15A to 15D project from the engaging surfaces S formed by the bottom walls by the predetermined distances corresponding to the external circuits to be connected. Therefore, when the connectors are inserted until they come into contact with the engaging surfaces S, the input/output terminal portions of the cramping terminals 15A to 15D are inserted and connected with the female terminals of the mating connectors by the predetermined length.

Figure 3:
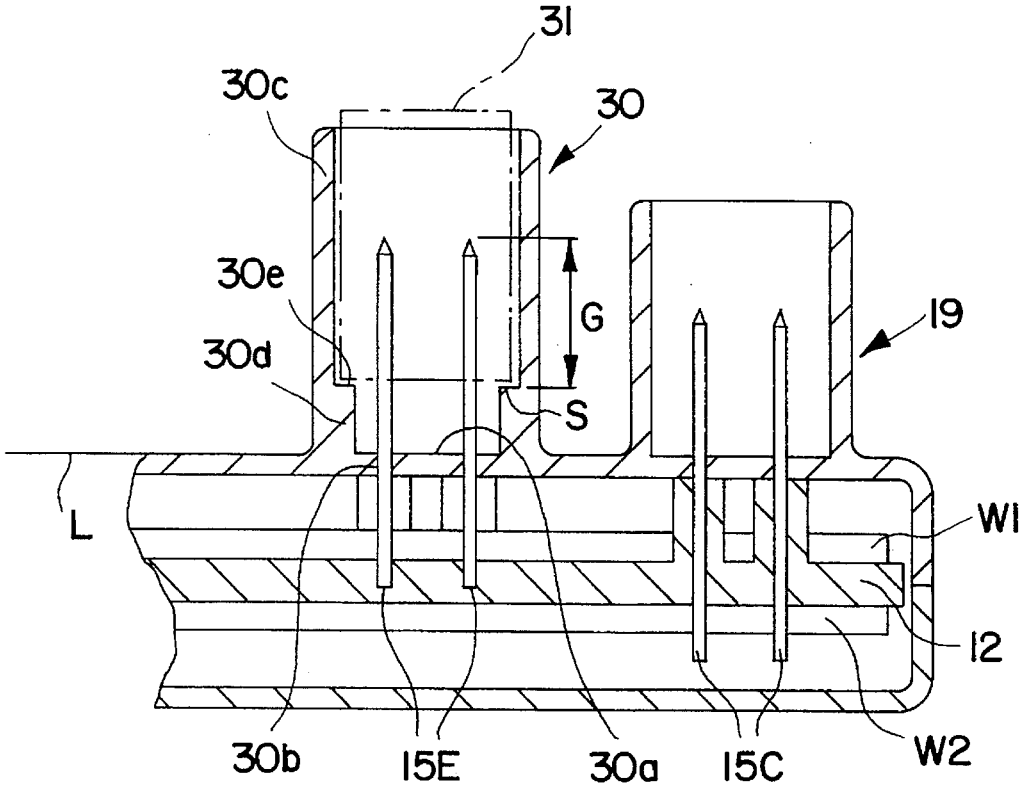
FIG. 3 is a longitudinal section of a second embodiment according to the invention.

FIG. 3 shows a second embodiment of the first aspect of the invention. In the second embodiment, a connector receptacle 30 whose bottom wall needs to be located above a reference line L is, nevertheless, located on the reference line L. A rib 30*d* projects from the inner surface Of a side wall 30*c* of the receptacle 30, and an upper end face 30*e* thereof serves as an engaging surface S.

A distance G between the engaging surface S and the leading end of a cramping terminal 15E is a length necessary for the cramping terminal 15E to be properly connected with a connector 31 fitted in the connector receptacle 30.

When the connector 31 is inserted into the receptacle 30, the periphery of the leading end surface of the connector 31 comes into contact with the rib 30*d*, and the input/output terminal portions of the cramping terminals 15E projecting from the position of the engaging surface S are inserted into the connector 31.

Figure 4:
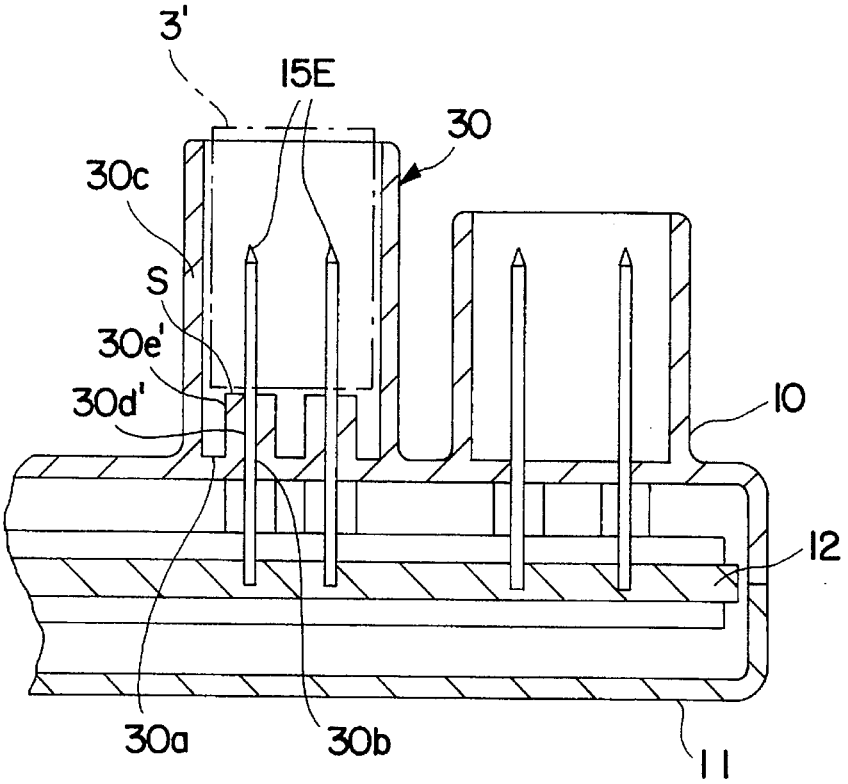
FIG. 4 is a longitudinal section of a third embodiment according to the invention.

FIG. 4 shows a third embodiment of the first aspect of the invention, which includes ribs 30*d'* for adjusting the height of the engaging surface S projecting from the bottom wall 30*a*, instead of the rib formed on the surrounding wall of the receptacle 30.

The leading end surface of the connector 31 being inserted into the receptacle 30 comes into contact with upper end surfaces 30*e'* of the ribs 30*d'* which in turn serve as the engaging surface S.

Figure 5:
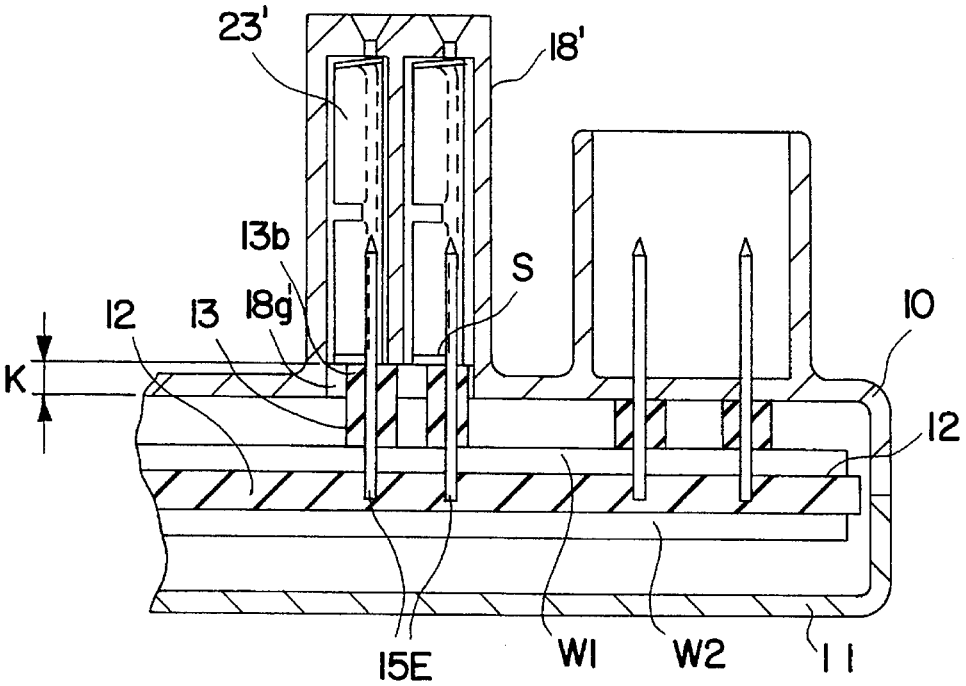
FIG. 5 is a longitudinal section of a fourth embodiment according to the invention.

FIG. 5 shows a fourth embodiment of the first aspect of the invention, in which ribs for adjusting the height of the engaging surface S project from the insulating plate 12 instead of being formed in the receptacle unitarily formed with the casing. This embodiment is particularly useful if fuses or relays have to be connected to the connection box. Namely, in this case an intermediate terminal 23 has to be used for connecting the male terminals of the fuse or relay with the male cramping terminals 15E.

More specifically, a receptacle 18' projecting from the upper casing 10 is formed not with a bottom wall, but with an opening 18*g'*. Ribs 13*b* having a height of K are provided on the upper surfaces of guides 13 which project from the insulating plate 12 and is adapted to retain the wire in a specified position. The ribs 13*b* project into the interior of the receptacle 18' through the opening 18*g'*. It should be appreciated that the receptacle 18' is closed at its top so that an intermediate terminal 23' which engages the ribs 13*b* can be inserted into the receptacle 18' from inside.

The lower end surfaces of relay terminals fitted into the receptacle 18' come into contact with the upper surfaces of the ribs 13*b*, which in turn serve as the engaging surface S. A projecting distance of the cramping terminals 15E from this engaging surface S is set at a predetermined value.

As is clear from the above,description of the first aspect of the invention, even if the cramping terminals of the same shape are used to be cramped with a wire or wires arranged on the same horizontal plane, the projecting distances of the cramping terminals from the engaging surfaces for the external circuits are changed by changing the height of the engaging surfaces. Accordingly, the cramping terminals can be inserted by a respective specified length into the corresponding circuit members to be connected therewith.

In other words, it is not necessary to prepare many types of cramping terminals in conformity with the mating external circuit members such as connectors, relays and fuses. This advantageously leads to a reduced production cost and a simpler parts management.

According to preferred embodiments of the first aspect of the invention, the height of the engaging surface can be changed by changing the height of the bottom wall of a receptacle unitarily formed with a casing or by forming a rib projecting from the bottom wall or the side wall of the receptacle. Thus, the height of the engaging surface can easily be changed by bringing the mating external circuit member into contact with the bottom wall or the rib. Further, the invention is easily implementable since the engaging surface is unitarily formed with the casing.

According to another embodiment of the first aspect of the invention, if a rib for adjusting the height of the engaging surface projects from an insulating plate and an opening is formed in the bottom wall of the receptacle, the cramping terminals of the same shape can also be used for parts which require the use of relay terminals.

Figure 6:
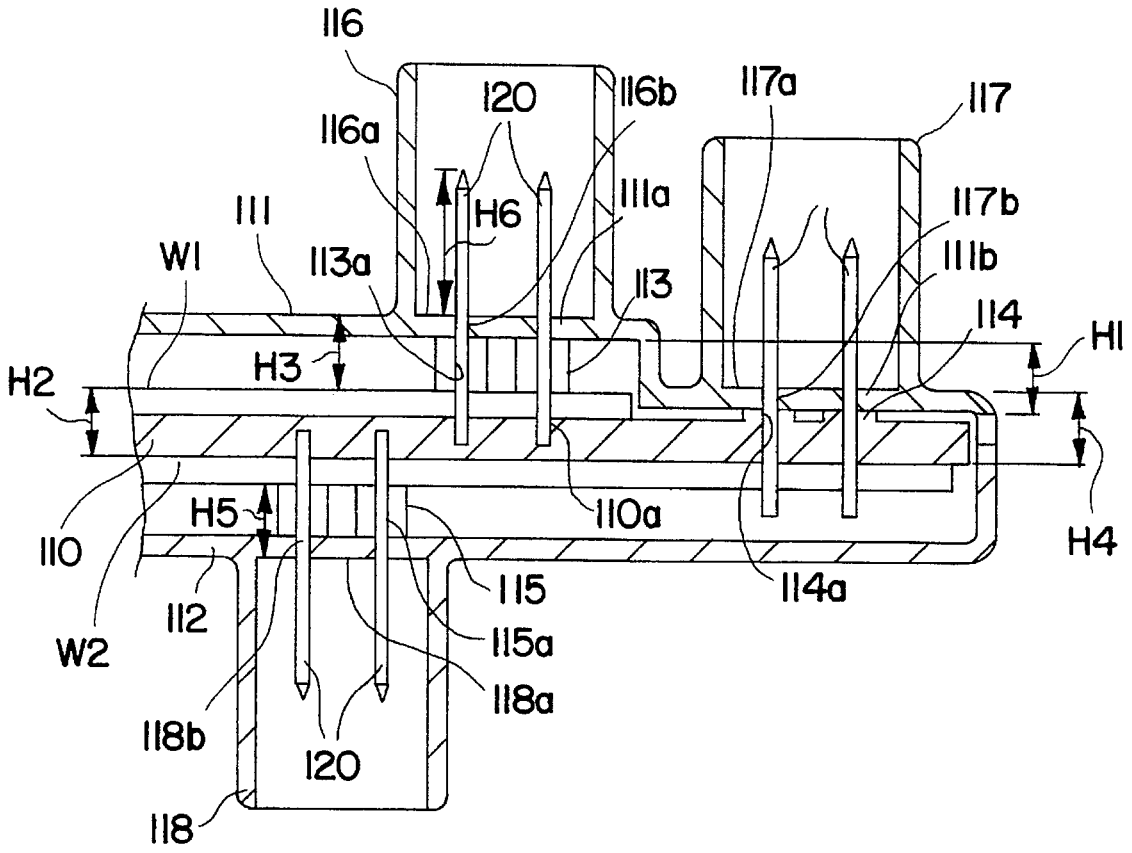
FIG. 6 is a longitudinal section of a fifth embodiment according to the invention.
Figure 7:
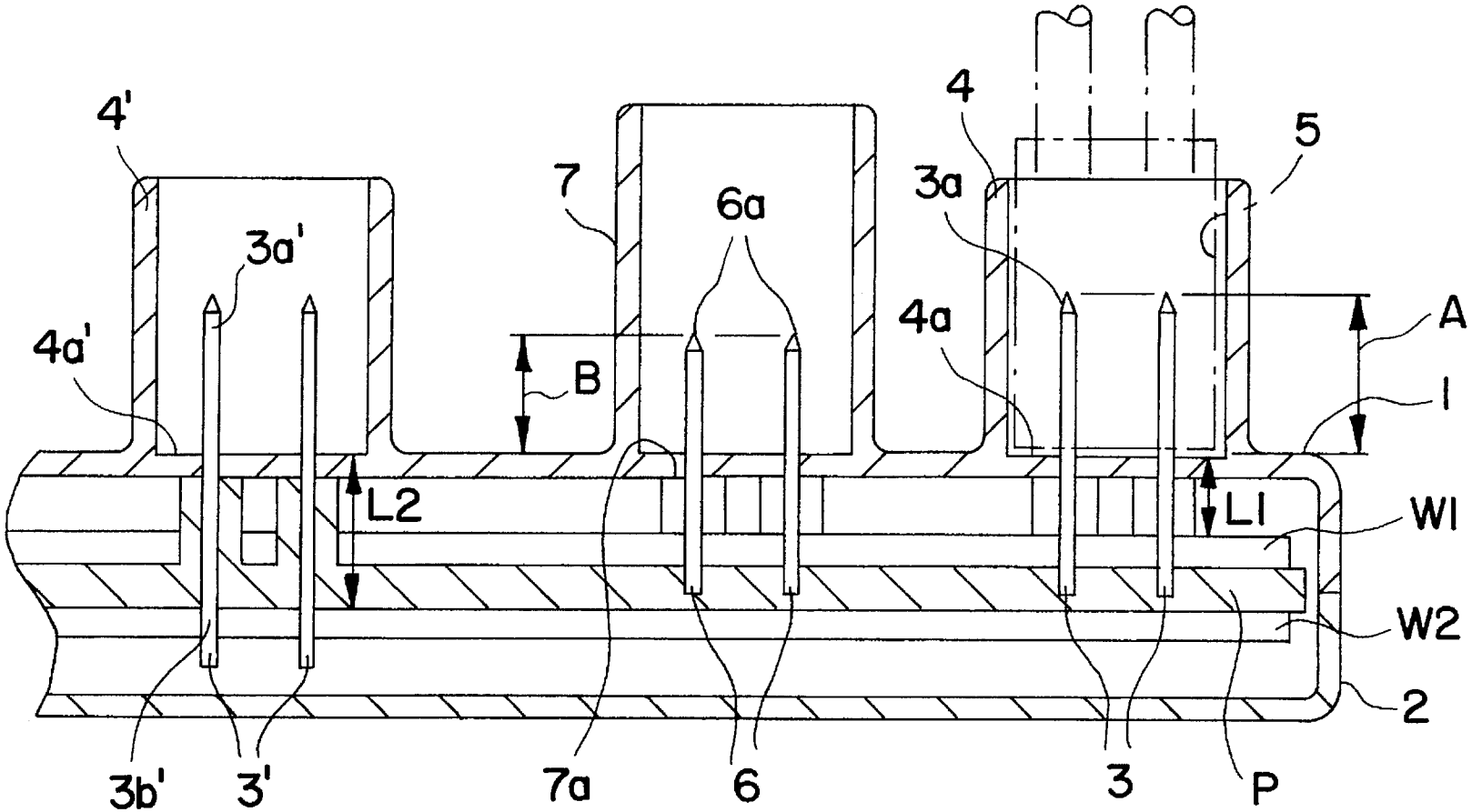
FIG. 7 PRIOR ART
FIG. 7 is a longitudinal section showing a problem residing in a prior art electrical connection box.

An embodiment of a second aspect of the invention is described in detail with respect to FIG. 6.

In the embodiment shown in FIG. 6, insulated wires are arranged at two stages. Specifically, first and second wires W1 and W2 are arranged on the upper and lower surfaces of an insulating plate 110, respectively.

The insulating plate 110 is mounted in the space defined by upper and lower casings 111 and 112 and is formed with projections 113, 114 and 115, in conformity with a wiring pattern, at positions where cramping terminals are to be applied. The projections 113, 114 and 115 also act to guide the wires W1, W2. At each of these positions of the wiring pattern, there is a pair of projections 113,114 or 115 spaced apart from each other in a lengthwise direction of the corresponding wire. Each of the projections 113, 114 and 115 is constituted by a pair of projections which are spaced apart by a distance substantially equal to the diameter of the wire (see FIG. 2). The wires are arranged while being inserted between the pairs of the projections 113, 114 and 115.

On the opposing inner surfaces of the respective pairs of projections 113, 114 and 115, there are formed guide grooves 113*a*, 114*a* and 115*a*. The insulating plate 110 is formed with a groove 110*a* which is in communication with the grooves 113*a* to 115*a*.

The heights of the projections 113 and 114 are set such that the end faces thereof are in contact with the inner surface of the wall of the upper casing 11. Further, the height of the projections 115 is set such that the end faces thereof are in contact with the inner surface of the wall of the lower casing 112.

At the left side of FIG. 6, the wires are arranged vertically at two stages, i.e., the first and second wires W1 and W2 are arranged on the upper and lower surfaces of the insulating plate 110, respectively. However, at the right side of FIG. 6, one wire is arranged at one stage only, i.e. the second wire W2 is arranged on the lower surface of the insulating plate 110 while the first wire W1 is not arranged on the upper surface thereof. In other words, the number of stages for arranging the wires differs depending upon the portion of the electrical connection box.

A wall portion 111*a* of the upper casing 111 which is in contact with the end faces of the projections 113 formed at positions where the cramping terminals are to be cramped with the first wire W1 and a wall portion 111*b* thereof which is in contact with the end faces of the projections 114 formed at positions where the cramping terminals are to be cramped with the second wire W2 have a different height (measured e.g. from the insulating plate 110) by a distance H1. As a result, the wall of the upper casing 111 is formed into a step-like shape.

A connector receptacle 116 is formed on the higher wall portion 111*a* in a position corresponding to the projections 113, whereas a connector receptacle 117 is formed on the lower wall portion 111*b* in a position corresponding to the projections 114.

The wall of the upper casing 111 forms the bottom walls of the connector receptacles 116 and 117, the outer surfaces of which act as engaging surfaces 116*a* and 117*a* for the external terminals. Thus, the engaging surfaces 116*a* and 117*a* are at different height by the distance H1.

The distance H1 is set equal to a distance H2 which is a distance between arranging positions of the first and second wires W1 and W2 (or in other words, a sum of the diameter of one wire and the thickness of the insulating plate 110). Thus, a distance H3 between the first wire W1 and the engaging surface 116*a* is equal to a distance H4 between the second wire W2 and the engaging surface 17*a*.

The lower casing 112 is formed, in a position corresponding to the projections 115, with a connector receptacle 118 for accommodating a connector (not shown) to be connected with the second wire W2. A distance H5 between an engaging surface 118*a* of the receptacle 118 and the second wire W2 is set equal to the distances H3 and H4.

Terminal holes 116*b*, 17*b* and 118*b* are formed in the bottom walls of the connector receptacles 116, 117 and 118, i.e. in the walls of the upper and the lower casings 111 and 112.

All cramping terminals 120 which are to be cramped with the first and the second wires W1 and W2 and are to project into the receptacles 116, 117 and 118 through the terminal holes 116*b*, 17*b* and 118*b* have the same shape (see FIG. 2). These cramping terminals 120 have a known shape and include each a wire cramping portion having a slot at one end and a tab-shaped input/output terminal portion at the other end. A blade formed at the periphery of each slot cuts an insulation of the wire to establish an electrical connection between the cramping terminal and the wire.

The input/output terminal portions of the respective cramping terminals 120 project into the connector receptacles 116, 117 and 118 through the terminal holes 116*b*, 17*b* and 118*b* by a distance H6. This projecting distance H6 is constant among all cramping terminals 120.

Connectors (not shown) including terminals connected with wires are to be inserted into the connector receptacles 116, 117 and 118 so as to connect these terminals with the input/output terminal portions 120*c* of the cramping terminals 120.

The portion of the connection box where the stepped portion is formed on the casing by varying the number of the stages, i.e., the wall portion 111*b* which causes the stepped portion in the upper wall of the upper casing 111 in FIG. 1 is found only in one location along the outer wall of the upper casing 111.

In the foregoing embodiment, the wires are arranged at two vertical stages. In the case of forming three or more wiring stages, a two-staged portion may be arranged on the outside of a one-staged portion, a three-staged portion may be arranged on the outside of the two-staged portion, and so on. The invention can be applied by successively forming such stepped portions along the outer wall of the casing.

Further, in the foregoing embodiment, the projections are formed on the surfaces of the insulating plate 110 so as to guide and retain the wires. However, it is also preferable to form grooves in a thick insulating plate 110 and to retain the wires by inserting them into these grooves.

As is clear from the above description of the embodiment of the second aspect of the invention, the cramping terminals of the same shape can be used even in the case where the internal circuits of the electrical connection box are arranged in a highly compact manner by arranging the wires at multiple stages.

This obviates the need for the use of different types of cramping terminals, thus reducing a production cost and simplifying the parts management.

Although the upper wall of the upper casing and the lower wall of the lower casing are not flat, this causes no problem.

If the casings are made of resin, it is easy to form them. Advantageously, there are some cases where the interference of the electrical connection box with the other members may be avoided by forming the stepped portion(s) in the casing.

What is claimed is:

1. An electrical connection box comprising a casing (10,11;111,112) having receiving portions (17–20;30;18';116,117) for making a mechanical connection with connecting portions (22–25;31;3';23) of external circuits, wherein an engaging surface (S;116*a*–118*a*) is formed in association with each of the receiving portions for the connecting portion of the respective external circuit, and internal circuits (W1,W2,15A–15D;W1,W2,15E;W1, W2,120) comprising wires (W1,W2) arranged in at least one stage and connection terminals (15A–15D;15E;120) which are connected with any of the wires (W1,W2) and which extend to respective receiving portions (17–20;30;18';116,117) of the casing (10,11;111,112) so as to form input/output terminal portions (15*c*) for the electrical connection with the external circuits, where the electrical connection box is formed such that, using one type of connection terminal (15A–15D;15E;120), the distance between the connection point of a connection terminal with a wire (W1,W2) and the corresponding engaging surface (S;116*a*–118*a*) is adjusted in accordance with the type of connecting portions(22–25;31;3';23) of the external circuit.

2. An electrical connection box according to claim 1, wherein the engaging surfaces (S; 116*a*–118*a*) are formed by the wall of the casing (10,11;111,112).

3. An electrical connection box according to claim 2, wherein the shape of the casing (111,112) is adjusted to the type of connecting portion in that the distance (H3–H5) between the connection point and the corresponding engaging surface (116*a*–118*a*) is adjusted by forming steps in the wall of the casing, said steps being located outside the receiving portions (116,117)(FIG. 6).

4. An electrical connection box according to claim 2, wherein the shape of the casing (10,11) is adjusted to the type of connecting portion (22–25;31;3') in that the distance between the connection point and the corresponding engaging surface (S) is adjusted within the receiving portions (17–20;30).

5. An electrical connection box according to claim 4, wherein the receiving portions are receptacles (17–20), the bottom wall (17*a*–20*a*) thereof forming the engaging surface (S) and being adjusted in height in accordance with the type of connecting portion (22–25).

6. An electrical connection box according to claim 4, wherein the receiving portions are receptacles (30), the inner surfaces of which have a shoulder (30*d*) forming the engaging surfaces (S) and being adjusted in height in accordance with the type of connecting portion (31).

7. An electrical connection box according to claim 4, wherein the receiving portions are receptacles (30), the bottom wall (30*a*) of which is provided with projection ribs (30*d'*) forming the engaging surfaces (S) and being adjusted in height in accordance with the type of connecting portion (3').

8. An electrical connection box according to claim 1, wherein the wires (W1,W2) are arranged at multiple stages, and separated by at least one plate (12;110).

9. An electrical connection box according to claim 8, wherein the plate is provided with projections (13) extending through an opening (18*g'*) in the wall of the casing (10,11) to the receiving portion (18'), forming the engaging surface (S) and having respective heights in accordance with the type of connecting portion (23).

10. An electrical connection box according to claim 3, wherein a stage distance (H2) between the wire arrangement stages is equal to the height (H1) of the steps formed in the wall of casing.

11. An electrical connection box according to claim 10, wherein the wires (W1,W2) are arranged along grooves formed in the plate(s) or along projections (13; 113,114,115) formed on the plate(s) (12;110).

12. An electrical connection box according to claim 8, wherein a specified number of wire arrangement stages is found only in one location along one direction so that the outer surface of the casing (11,12) is formed in a stair-like manner.

* * * * *